US009470480B2

(12) United States Patent
Kirchhoff

(10) Patent No.: US 9,470,480 B2
(45) Date of Patent: Oct. 18, 2016

(54) WEAPON ACCESSORY MOUNT

(71) Applicant: Sig Sauer, Inc., Newington, NH (US)

(72) Inventor: Niels Kirchhoff, Lübeck (DE)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/640,561

(22) Filed: Mar. 6, 2015

(65) Prior Publication Data

US 2015/0253090 A1 Sep. 10, 2015

Related U.S. Application Data

(60) Provisional application No. 61/949,005, filed on Mar. 6, 2014.

(51) Int. Cl.
*F41G 11/00* (2006.01)
*F41C 27/00* (2006.01)

(52) U.S. Cl.
CPC ..... *F41G 11/001* (2013.01)

(58) Field of Classification Search
CPC ..... F41A 21/488; F41G 1/387; F41G 11/00; F41G 11/001; F41G 11/002; F41G 11/003; F41G 11/004
See application file for complete search history.

(56) References Cited

U.S. PATENT DOCUMENTS 3,877,166 A * 4/1975 Ward ..... F41G 11/003 42/127
4,338,740 A 7/1982 Miller
4,418,487 A * 12/1983 Strahan ..... F41G 11/001 42/125
5,107,612 A * 4/1992 Bechtel ..... F41G 11/003 42/115
D328,632 S * 8/1992 Bigwood ..... 89/14.3
7,076,908 B2 7/2006 Kim
7,194,836 B1 * 3/2007 Urban ..... F41C 27/22 42/106
7,395,627 B2 * 7/2008 La France ..... F41G 11/003 362/110
7,882,654 B1 * 2/2011 Marcum ..... F41C 27/00 42/146
D672,840 S * 12/2012 Neufeld ..... D22/108
8,371,056 B1 * 2/2013 Baker ..... F41G 11/003 42/106
8,393,108 B1 * 3/2013 Wilson ..... F41G 11/003 42/111
D687,508 S * 8/2013 Peterman ..... D22/108
8,522,469 B2 * 9/2013 Baker ..... F41G 11/003 42/124
8,714,072 B1 * 5/2014 Villarreal ..... F41G 3/165 42/130
8,857,096 B2 * 10/2014 McClintock ..... F41C 27/00 42/72
D728,729 S * 5/2015 Geissele ..... D22/109
D741,442 S * 10/2015 Wilson ..... D22/108
2005/0229465 A1 * 10/2005 Dextraze ..... F41G 11/003 42/85
2006/0075674 A1 * 4/2006 Ding ..... F41G 11/003 42/124
2007/0137087 A1 * 6/2007 Florea ..... F41G 11/004 42/90
2009/0064558 A1 * 3/2009 Woroner ..... F41G 11/003 42/90

(Continued)

*Primary Examiner* — Bret Hayes
*Assistant Examiner* — Derrick Morgan
(74) *Attorney, Agent, or Firm* — Finch & Maloney PLLC

(57) ABSTRACT

A mounting apparatus for mounting an accessory to a weapon is disclosed. In some embodiments, the mounting apparatus includes a base plate having a side member parallel to a longitudinal axis of the base plate. The base plate is configured to be coupled to an under barrel of a firearm. The mounting apparatus further includes one or more opposing side elements. Each side element is detachably coupled to the respective side member of the base plate such that the side element is positioned adjacent to a movable slide mechanism of the firearm while the base plate is coupled to the under barrel. In some embodiments, the mounting apparatus includes an adapter bridge and/or a barrel weight, which, in combination with the side elements, straddles, and avoids interfering with, the movable slide mechanism while the assembly is mounted to the firearm.

20 Claims, 10 Drawing Sheets

(56) References Cited

U.S. PATENT DOCUMENTS

2009/0101776 A1* 4/2009 Peterson ..... F41G 11/001 248/205.1
2010/0313462 A1* 12/2010 Holmberg ..... F41C 27/00 42/124
2011/0107644 A1* 5/2011 Faifer ..... F41C 23/04 42/75.02
2012/0159831 A1* 6/2012 LaFrance ..... F41G 11/001 42/90
2014/0047755 A1* 2/2014 McClintock ..... F41C 27/00 42/90
2014/0068994 A1* 3/2014 Schultz ..... F41G 11/003 42/124
2014/0157644 A1* 6/2014 Jiminez ..... F41G 11/003 42/114
2014/0245648 A1* 9/2014 Nierenberg ..... F41C 23/08 42/1.06
2015/0159977 A1* 6/2015 Tseng ..... F41C 23/12 42/75.03

* cited by examiner

WEAPON ACCESSORY MOUNT

RELATED APPLICATIONS

This application claims the benefit under 35 U.S.C. §119 (e) of U.S. Provisional Patent Application Ser. No. 61/949,005, filed Mar. 6, 2014, which is incorporated herein by reference in its entirety.

FIELD OF THE DISCLOSURE

This disclosure relates generally to mounting devices, and more particularly, to a mounting apparatus for mounting an accessory to a weapon or other object.

BACKGROUND

Firearm accessories, such as target illuminators, sights and other optics, are typically attached to the firearm using a standardized mounting platform. One common mounting platform is the Picatinny rail, also known as a MIL-STD-1913 rail, STANAG 2324 rail, or tactical rail, although other mounting platforms have been developed for specific applications. These mounting platforms are often attached to some part of the firearm so as to provide for a relatively fixed alignment of the accessory to the bore of the weapon. A number of devices have been developed for mounting accessories to the slide of a handgun, which moves relative to the barrel when the handgun is fired. Due to limits on the manufacturing and design tolerances in the interface between the barrel and the slide, the relationship between the barrel and any accessory mounted to the slide can change with each shot, introducing inaccuracy. Some aiming device accessories have instead been mounted directly to the barrel of the weapon to minimize any relative movement between the bore and the aiming device. However, in some handguns, including semi-automatic pistols, the barrel is encased within the slide, which makes mounting an accessory directly to the barrel difficult.

SUMMARY

According to an embodiment, a mounting apparatus for a handgun includes a base plate having a side member parallel to a longitudinal axis of the base plate, the base plate being configured to be coupled to an under barrel of a firearm, and a side element detachably coupled to the side member of the base plate such that the side element is positioned adjacent to a movable slide mechanism of the firearm while the base plate is coupled to the under barrel. In some cases, the base plate has an opposing side member parallel to the longitudinal axis of the base plate, and the apparatus further comprises an opposing side element detachably coupled to the opposing side member of the base plate such that both side elements are positioned adjacent to the movable slide mechanism of the firearm while the base plate is coupled to the under barrel. In some cases, the apparatus includes an adapter bridge coupled to at least one of the side elements such that the adapter bridge is positioned above and avoids interfering with the movable slide mechanism while the adapter bridge is mounted to the firearm. In some such cases, the adapter bridge includes a Picatinny rail, an optic-specific mount, or both, for mounting an accessory thereto. In some cases, the apparatus includes a barrel weight coupled to at least one of the side elements such that the barrel weight straddles a muzzle of the firearm while the base plate is coupled to the under barrel. In some cases, the apparatus includes a screw, where the side member and the side element each have bores configured to be axially aligned with each other and to receive the screw for securing the side member and the side element together. In some cases, the apparatus includes a tongue disposed on the side member of the base plate, the tongue being configured to engage a complementary groove formed in the under barrel. In some cases, the apparatus includes a fastener configured to secure the base plate to the under barrel. In some such cases, the fastener is threaded into an opening formed through the base plate.

According to another embodiment, a kit includes a base plate having a side member parallel to a longitudinal axis of the base plate, the base plate being configured to be coupled to an under barrel of a firearm, and a side element configured to be detachably coupled to the side member of the base plate such that the side element is positioned adjacent to a movable slide mechanism of the firearm while the base plate is coupled to the under barrel. In some cases, the base plate has an opposing side member parallel to the longitudinal axis of the base plate, and the apparatus includes an opposing side element configured to be detachably coupled to the opposing side member of the base plate such that both side elements are positioned adjacent to the movable slide mechanism of the firearm while the base plate is coupled to the under barrel. In some cases, the kit includes an adapter bridge configured to be coupled to at least one of the side elements such that the adapter bridge straddles and avoids interfering with the movable slide mechanism while the adapter bridge is mounted to the firearm. In some such cases, the adapter bridge includes a Picatinny rail, an optic-specific mount, or both, for mounting an accessory thereto. In some cases, the kit includes a barrel weight configured to be coupled to at least one of the side elements such that the barrel weight straddles a muzzle of the firearm while the base plate is coupled to the under barrel. In some such cases, the kit includes a screw, where the side member and the side element each have bores configured to be axially aligned with each other and to receive the screw for securing the side member and the side element together. In some cases, the kit includes a tongue disposed on the side member of the base plate, the tongue being configured to engage a complementary groove formed in the under barrel. In some cases, the kit includes a fastener configured to secure the base plate to the under barrel. In some such cases, the fastener is threaded into an opening formed through the base plate.

According to another embodiment, a mounting apparatus for a handgun includes a base plate having a side member parallel to a longitudinal axis of the base plate, the base plate being configured to be coupled to an under barrel of a firearm, and a pair of opposing side elements each extending upwardly from respective side members of the base plate such that the side elements are positioned adjacent to a movable slide mechanism of the firearm while the base plate is coupled to the under barrel. In some cases, the apparatus includes an adapter bridge coupled to at least one of the side elements such that an assembly comprising the base plate, at least one of the side elements and the adapter bridge straddles, and avoids interfering with, the movable slide mechanism while the assembly is mounted to the firearm.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
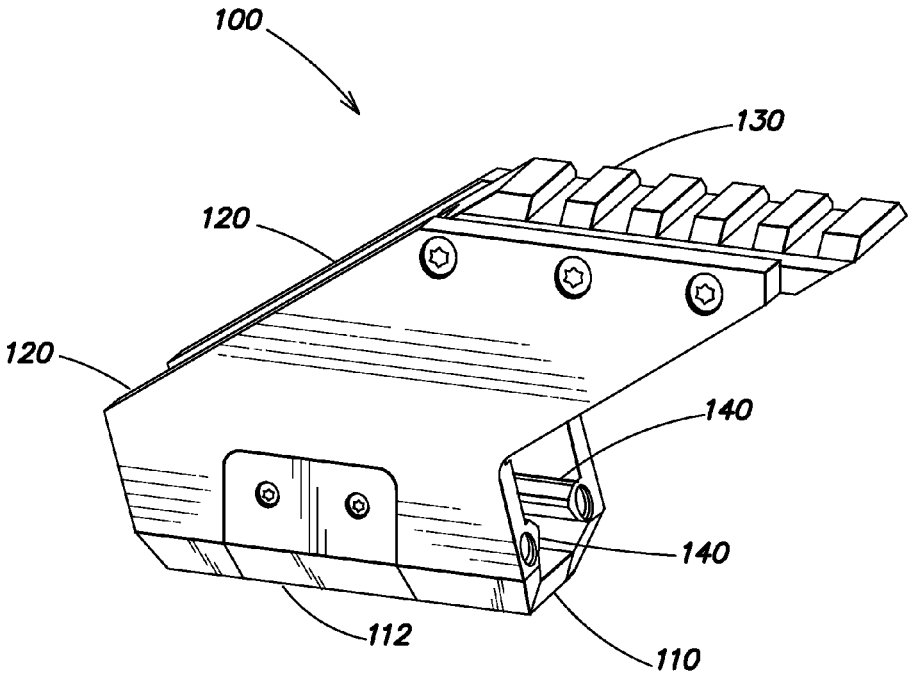
FIG. 1 is a perspective view of an example mounting apparatus, in accordance with an embodiment.

A mounting apparatus for mounting an accessory to a weapon is disclosed. In some embodiments, the mounting apparatus includes a base plate having opposing side members each parallel to a longitudinal axis of the base plate. The base plate is configured to be coupled to an under barrel of a firearm. The mounting apparatus further includes one or more opposing side elements. Each side element is detachably coupled to the respective side member of the base plate such that the side element is positioned adjacent to a movable slide mechanism of the firearm while the base plate is coupled to the under barrel. In some embodiments, the mounting apparatus includes an adapter bridge and/or a barrel weight, which, in combination with the side elements, straddles and avoids interfering with the movable slide mechanism while the assembly is mounted to the firearm. Numerous configurations and variations will be apparent in light of this disclosure.

General Overview

Some handguns have a barrel that is partially encased within a slide mechanism. The portion of the handgun below the bore and ahead of the trigger, also referred to herein as the under barrel, may be exposed. To this end, some existing mounting devices are designed to attach accessories to the under barrel. However, such designs suffer from a number of flaws and disadvantages. For example, with such designs the accessory is positioned below or to one side of the barrel, which is not suitable for some types of accessories, such as aiming sights, because the grip of the firearm and/or the hand of the operator interfere with the use of the accessory. Furthermore, placement of the accessory below or to the side of the barrel can adversely affect the balance of the handgun, making it more difficult to aim accurately. Accordingly, there is a need for an improved apparatus for mounting one or more accessories to a handgun that, for example, permits placement of the accessory or accessories in a variety of locations that are more suitable for use of the accessory and/or balance of the handgun, including above the barrel and adjacent to the muzzle.

Thus, and in accordance with a set of embodiments, an improved mounting apparatus for mounting an accessory to a weapon is disclosed. In some embodiments, the mounting apparatus includes a base plate having one or two opposing side members each parallel to a longitudinal axis of the base plate. The base plate is configured to be attached to an under barrel of a firearm using a fastener. Two opposing side elements can be attached to and detached from the respective side member of the base plate. When attached to the base plate, each side element is positioned adjacent to a movable slide mechanism of the firearm while the base plate is attached to the under barrel. In some embodiments, the mounting apparatus includes an adapter bridge and/or a barrel weight. The adapter bridge can be attached to the side elements such that the adapter bridge is positioned above and avoids interfering with the movable slide mechanism while the adapter bridge is mounted to the firearm. The barrel weight can be attached to at least one of the side elements such that the barrel weight is positioned adjacent to and avoids interfering with the moveable slide mechanism and the muzzle while the barrel weight is mounted to the fire arm. The mounting apparatus can be configured to hold any type of accessory, such as a light, scope, laser sight or barrel weight.

As will be appreciated in light of this disclosure, some embodiments may realize benefits or advantages as compared to existing approaches. For instance, in some embodiments, the disclosed mounting apparatus can be configured so that an accessory, such as an aiming device, can be mounted to, and positioned above, the barrel without interfering with the movement of the slide. In some other embodiments, a barrel weight can be mounted adjacent to the muzzle of the handgun without interfering with the movement of the slide or blocking the muzzle. In some further embodiments, a combination of an accessory and a barrel weight can be mounted to the handgun simultaneously, again without interfering with the movement of the slide or blocking the muzzle. For example, the accessory and/or barrel weight may be attached to the mounting apparatus to form an assembly that slides onto and off of the under barrel. Once the mounting apparatus is installed onto the under barrel, the accessory or accessories can be securely mounted to the handgun in fixed relation to the barrel. In this manner, the accessory or accessories are maintained in accurate alignment with the barrel of the handgun, and the slide is allowed to move without interference. Different types of accessory adapters may be attached to the mounting apparatus for mounting a variety of accessories. Various techniques disclosed herein are in contrast to existing approaches where, for example, the accessories are mounted below or to one side of the barrel, or directly to the slide.

In some cases, and in accordance with various embodiments, the mounting apparatus can be configured, for example, as: (1) a partially or completely assembled mounting assembly; (2) a partially or completely assembled mounting and accessory assembly; and/or (3) a kit or other collection of discrete components as variously described herein that may be used to practice one or more of the disclosed embodiments.

Some embodiments can be used, for example, for mounting various accessories, such as those mentioned herein, to handguns, pistols and other types of projectile weapons used by military and law enforcement personnel or by marksmen in general. However, the present disclosure is not so limited; for instance, some embodiments may be implemented with any type of object (including non-weapons) to which a suitable mounting rail, including but not limited to a Picatinny-, Weaver- or STANAG 4694-type rail, can be attached. Other suitable uses and implementations of one or more embodiments of the present disclosure will depend on a given application and will be apparent in light of this disclosure.

Structure and Operation

Figure 4A:
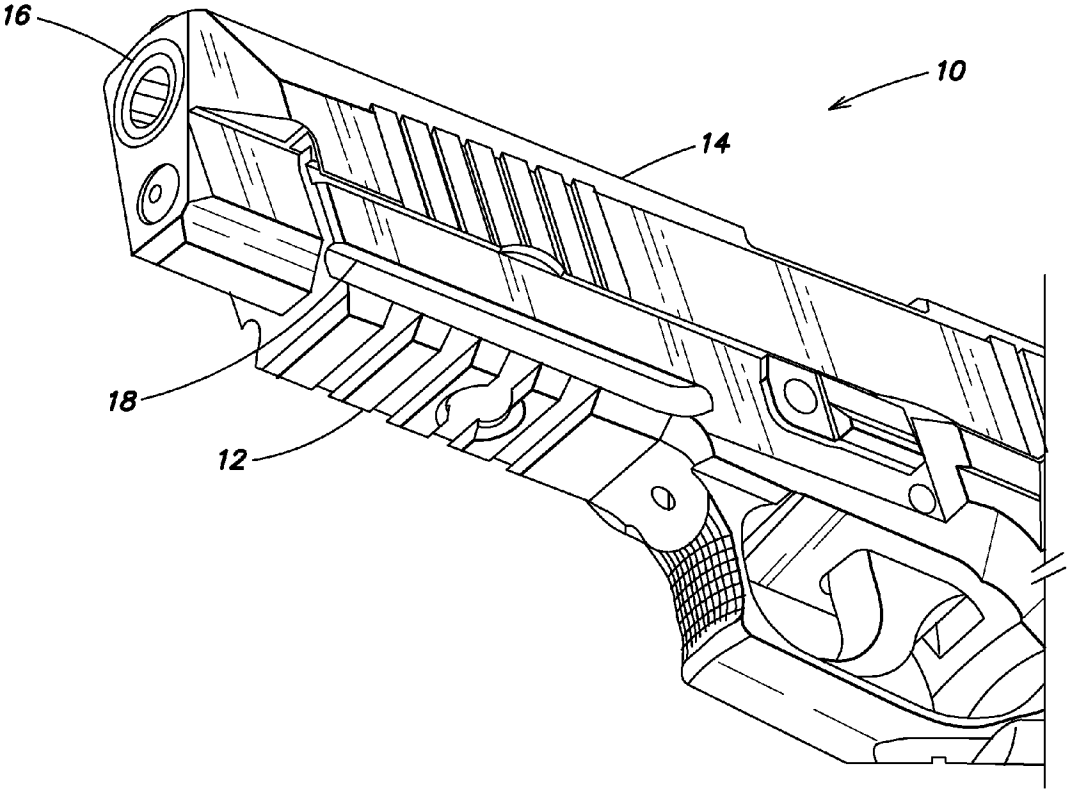
FIGS. 4*a* and 4*b* are perspective views of an example handgun that can be used in conjunction with various embodiments.

FIG. 1 is a perspective view of an example mounting apparatus 100, according to an embodiment. The apparatus 100 includes a base plate 110, a pair of side elements 120, and an adapter bridge 130 for attaching an accessory (not shown), such as a light, scope, laser sight, or any other type of accessory, to the apparatus 100. For reference, the adapter bridge 130 is shown as a Picatinny-type rail, although it will be understood that other types of adapters, such as optic-specific adapters, may be implemented in a similar manner. Various accessories may be attached to the adapter bridge 130 using a suitable attachment device, such as a clamp, clip, bolt or screw. The base plate 110 includes side members 112 (one of which is shown in FIG. 1) to which each of the side elements 120 can be attached. Each side element 120 extends upwardly from the base plate 100 to accommodate attachment of the adapter bridge 130. The adapter bridge 130 can be attached to and between each of the side elements 120 so that it is positioned above the barrel of a handgun when the mounting apparatus 100 is mounted to the handgun. The base plate 110 and/or the side elements 120 include inwardly facing mating surfaces 140 configured to engage complementary mating surfaces (such as depicted in FIG. 4*a*) of the under barrel of a handgun. For example, the mating surfaces 140 may include a longitudinally-oriented tongue that is configured to slide into a corresponding groove formed in the under barrel for attaching the mounting apparatus 100 to the handgun.

Figure 2:
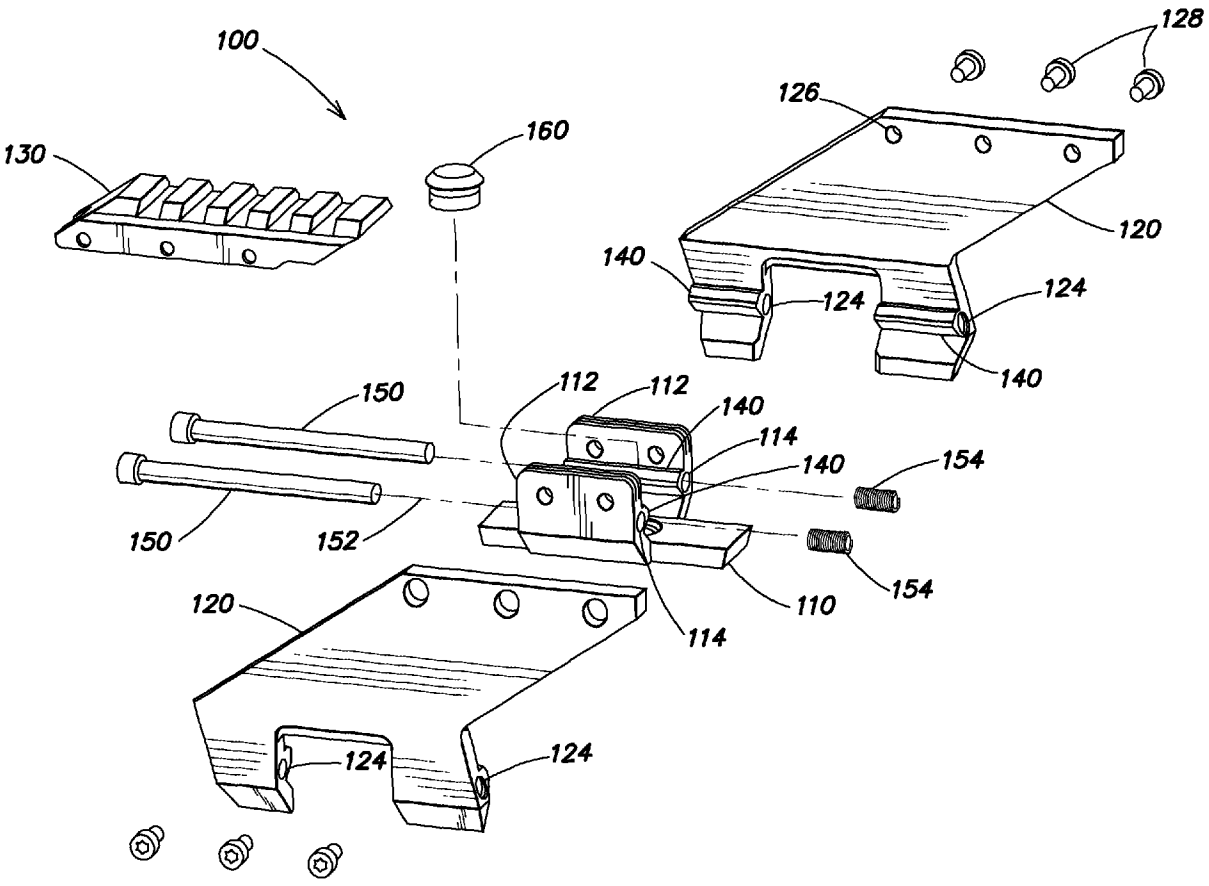
FIG. 2 is an exploded perspective view of the example mounting apparatus of FIG. 1, in accordance with an embodiment.
Figure 3:
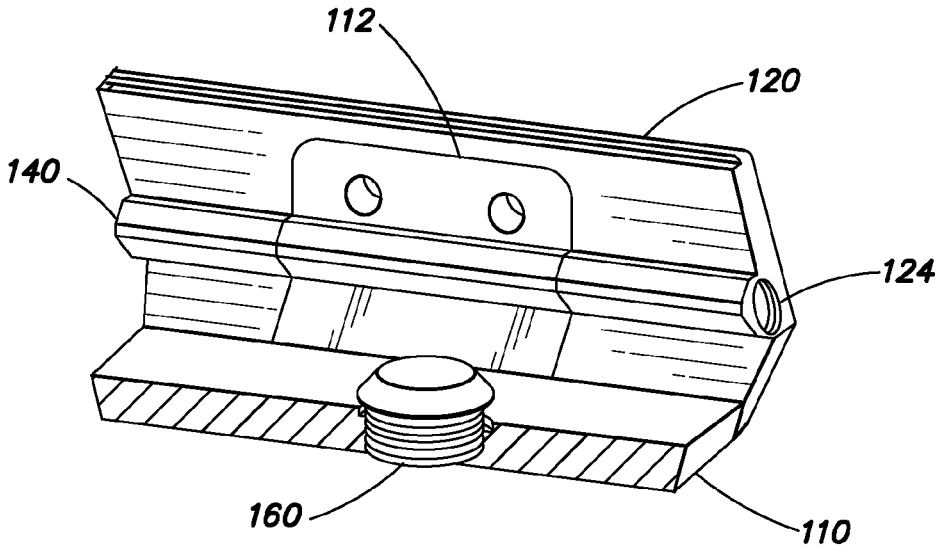
FIG. 3 is a perspective cut-away view of a portion of the example mounting apparatus of FIG. 1, in accordance with an embodiment.
Figure 4B:
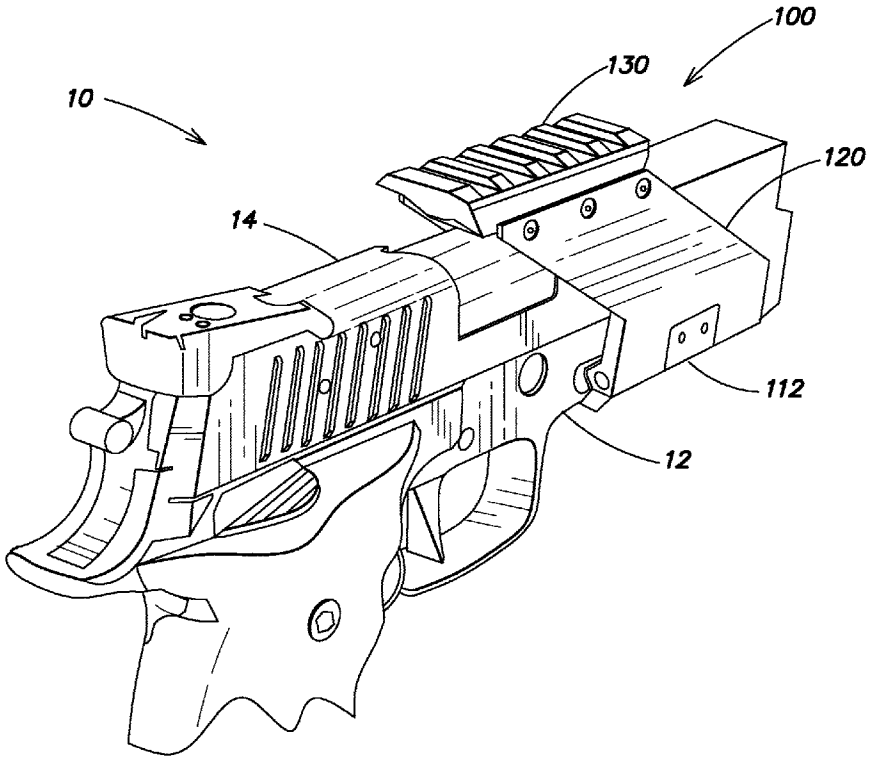

FIG. 2 is an exploded perspective view of the example mounting apparatus 100 of FIG. 1. FIG. 3 is a perspective cut-away view of the base plate 110 taken along an axial centerline. FIGS. 4*a* and 4*b* are perspective views of an example handgun 10 that can be used in conjunction with the example mounting apparatus 100, according to an embodiment. As shown in FIG. 2, each side member 112 of the base plate 110 has a bore 114, and each side element 120 has one or more corresponding bores 124. The bores 114 and 124 are situated such that they are axially aligned with each other while the side element 120 is applied to the side member 112. While the bores 114 and 124 are so aligned, a screw 150, bolt, pin or other type of fastener can be inserted through the bores 114 and 124, as indicated by broken line 152, to secure the respective side elements 120 and side members 112 together. A set of threads 154 for receiving and securing each screw 150 may be inserted into or formed within each of the bores 124. Also shown in FIG. 2 is a fastener 160 for securing the base plate 110 to an under barrel 12 of the handgun 10, such as depicted in FIG. 4*a*. The fastener 160 may, for example, thread upwardly through the base plate 110, such as shown in FIG. 3, to engage with or press against the under barrel 12. Other types of fasteners may be used, such as clamps, clips, screws and the like. Each of the side elements 120 can include one or more bores 126 for attaching the adapter bridge 130 to each of the side elements 120 using screws 128 or other fasteners. FIG. 3 more clearly shows one of the mating surfaces 140 of the base plate 110. The mating surface 140 (e.g., a tongue) can be configured to engage a complementary mating surface 18 (e.g., a groove) of the handgun 10, such as shown in FIG. 4*a*. The mating surface 140 can extend longitudinally along an inner portion of the base plate 110 and/or the side element 120. Thus, an assembly of the base plate 110, the side elements 120 and the adapter bridge 130 can be mounted to the handgun such that the side elements 120 and the adapter bridge 130 straddle a slide 14 of the handgun 10 without interfering with movement of the slide, such as shown in FIG. 4*b*.

Figure 5:
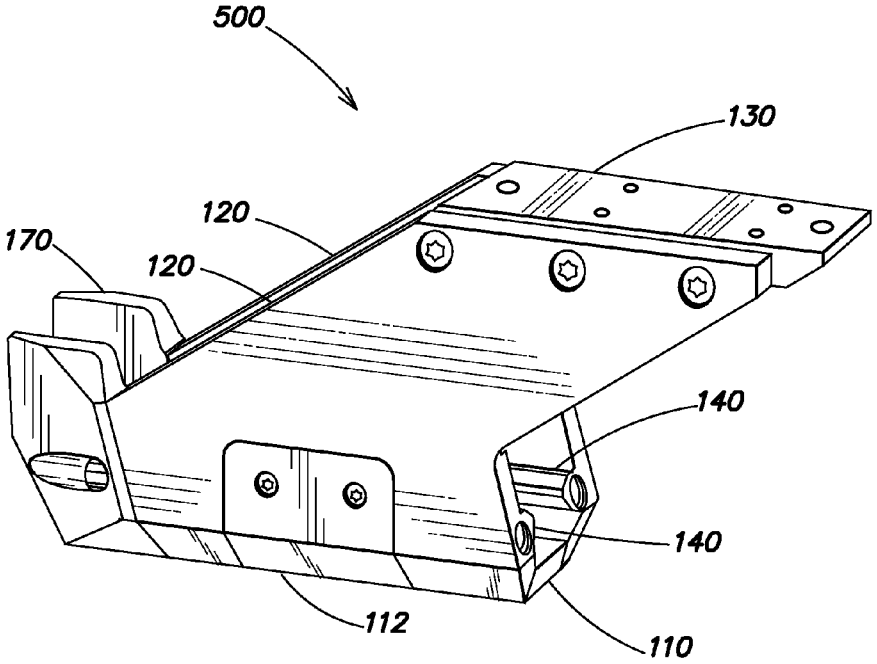
FIG. 5 is a perspective view of an example mounting apparatus, in accordance with another embodiment.
Figure 6:
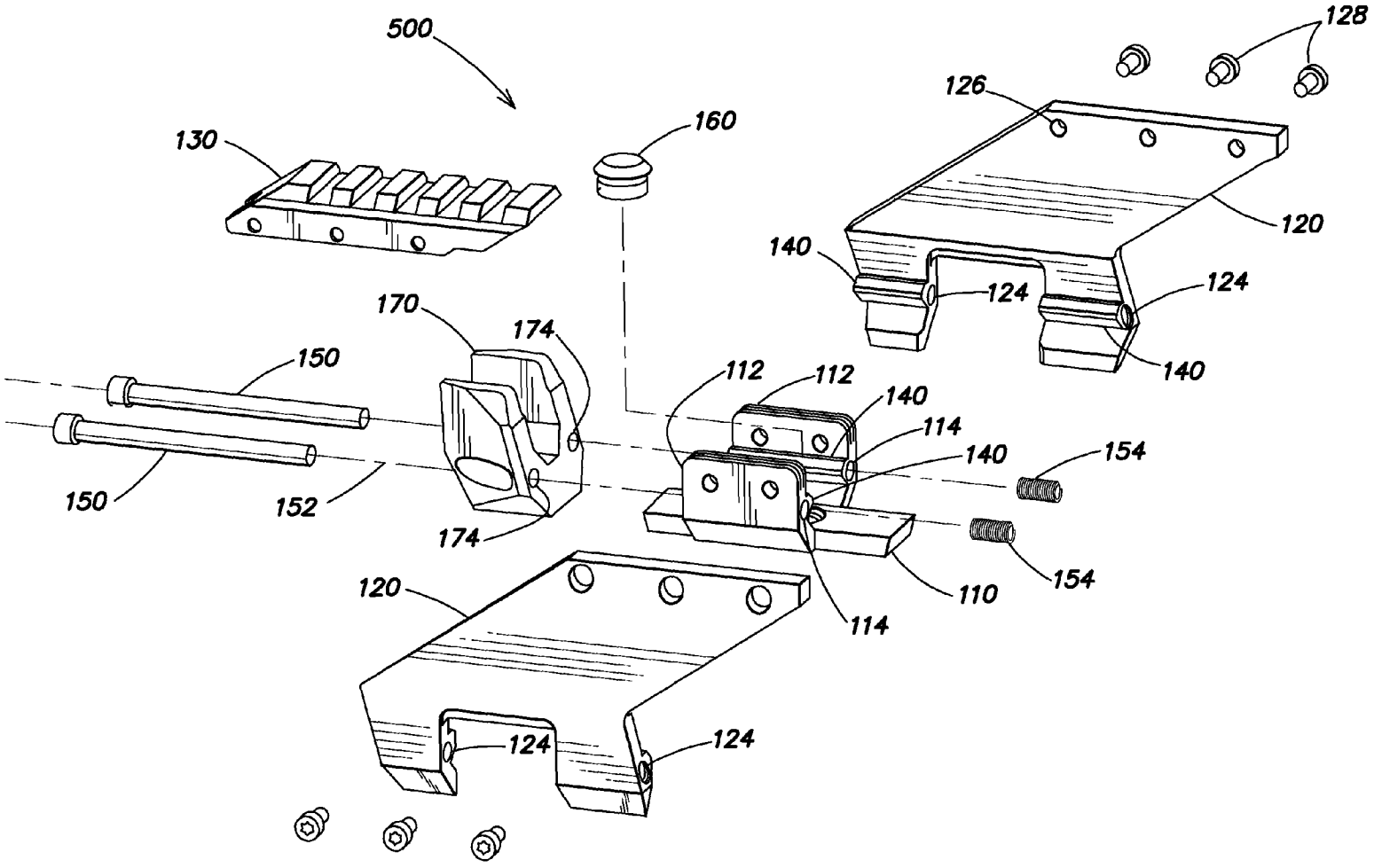
FIG. 6 is an exploded perspective view of the example mounting apparatus of FIG. 5, in accordance with an embodiment.
Figure 7:
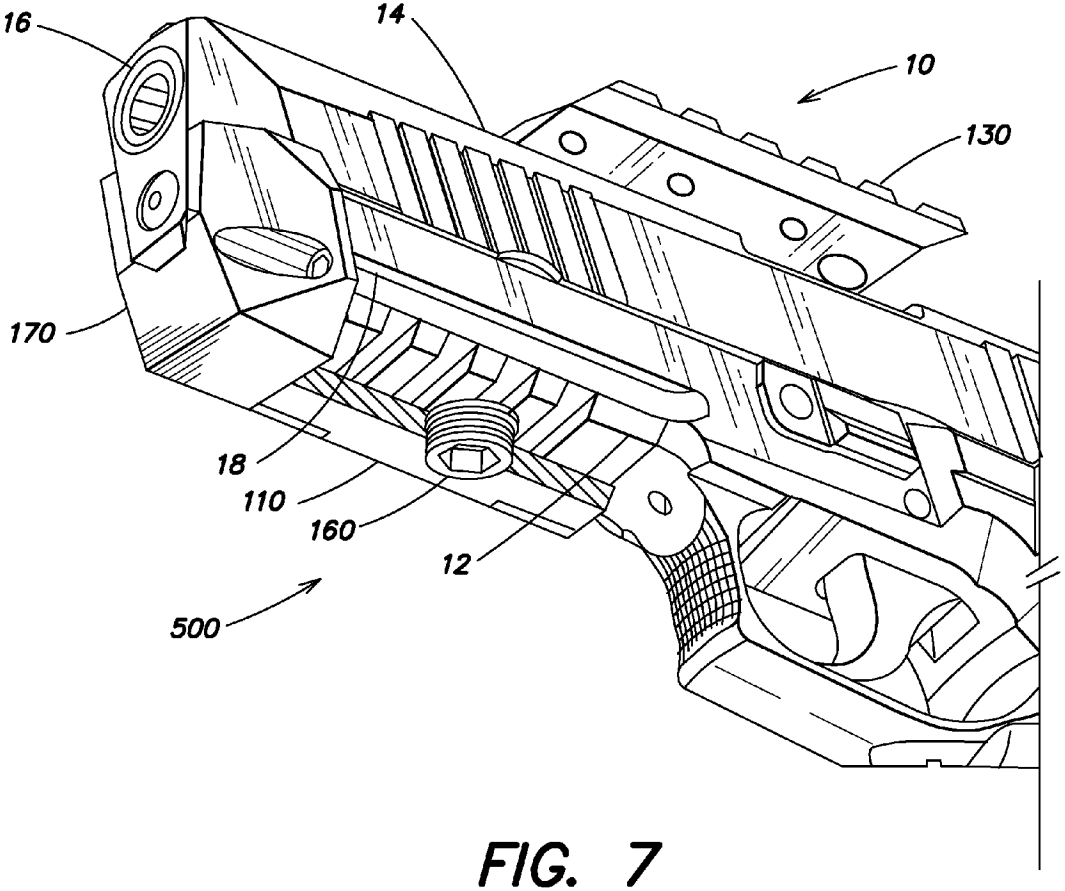
FIG. 7 is a perspective view of a partial cut-away of the example mounting apparatus of FIGS. 5 and 6 mounted to an example handgun that can be used in conjunction with various embodiments.

FIGS. 5 and 6 are perspective and exploded perspective views, respectively, of an example mounting apparatus 500 in accordance with another embodiment. FIG. 7 is a perspective view of a partial cut-away of the example mounting apparatus 500 of FIGS. 4 and 5 mounted to an example handgun 10 that can be used in conjunction with the example mounting apparatus 500. The example mounting apparatus 500 is substantially the same as the mounting apparatus 100 of FIG. 1, except that a barrel weight 170 can be attached to the base plate 110 and the side elements 120 using one or more of the screws 150 inserted through bores 174 in the barrel weight 170 that secure the base plate 110, the side elements 120 and the barrel weight 170 together. The barrel weight 170 can take on various forms, sizes and shapes as appropriate for a given application. For example, the size and composition of the barrel weight 170 may vary depending on the amount of weight desired. Referring to FIG. 7, the barrel weight 170, when attached to the mounting apparatus 500, is configured to straddle a muzzle 16 of the handgun 10 while the mounting apparatus 500 is mounted to the handgun 10. In the perspective view of FIG. 7, the proximal side element 120 is not shown and only the distal portion of the base plate 110 is shown to more clearly depict the fastener 160 engaged with the under barrel 12.

Figure 8:
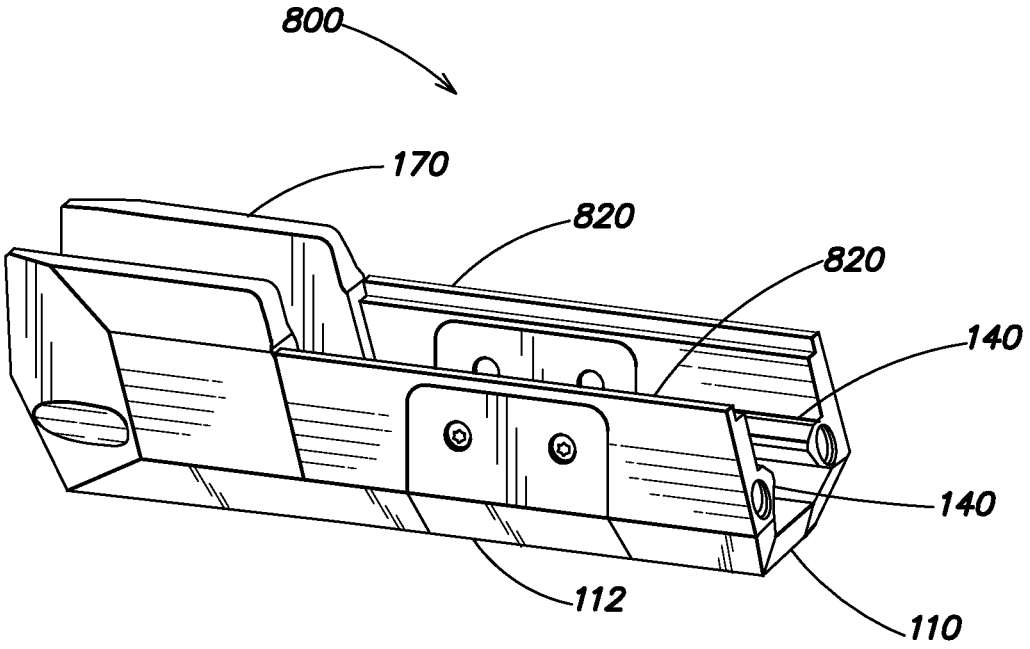
FIG. 8 is a perspective view of an example mounting apparatus, in accordance with another embodiment.
Figure 9:
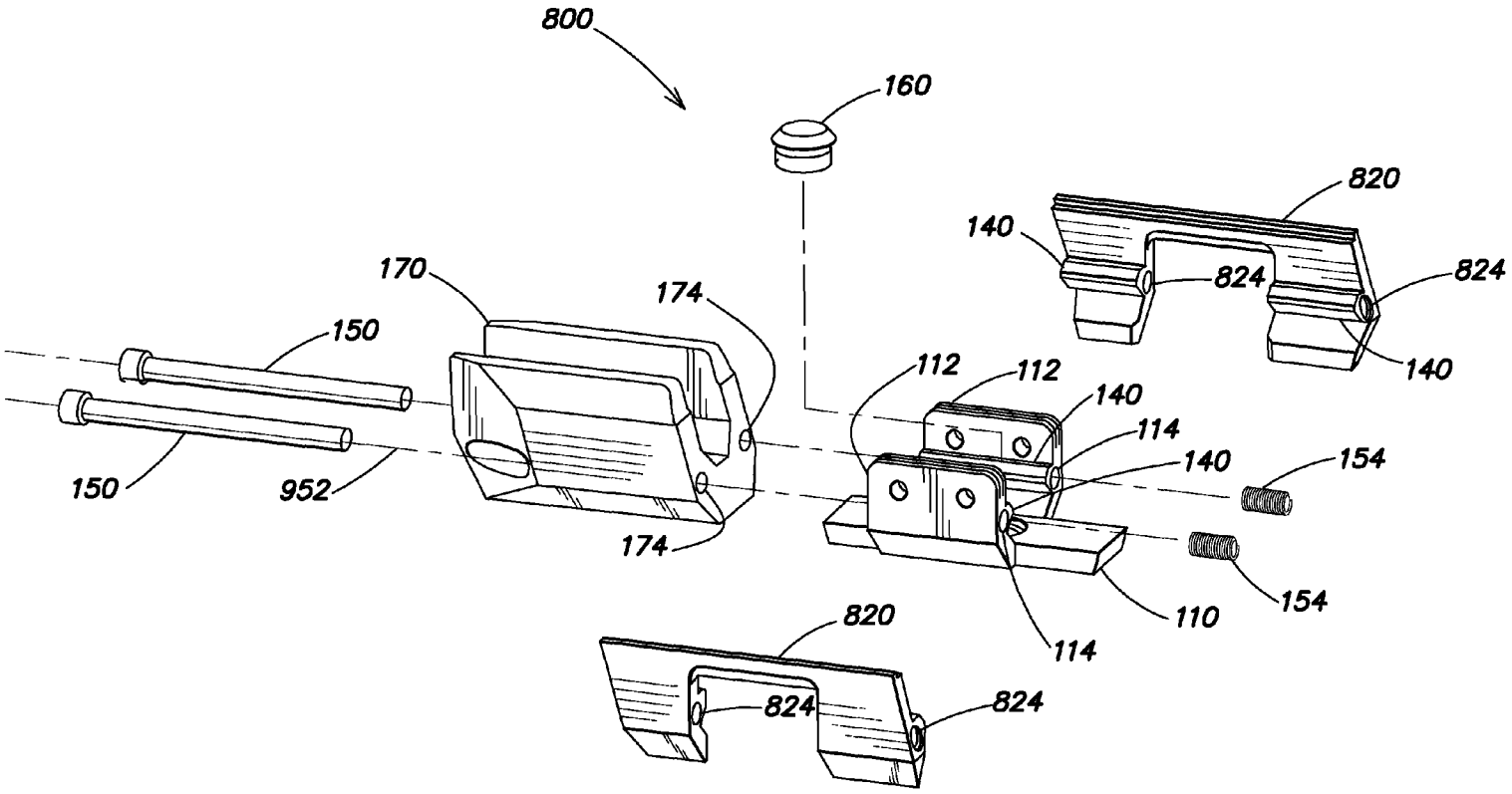
FIG. 9 is an exploded perspective view of the example mounting apparatus of FIG. 8, in accordance with an embodiment.

FIGS. 8 and 9 are perspective and exploded perspective views, respectively, of an example mounting apparatus 800 in accordance with another embodiment. The example mounting apparatus 800 is substantially the same as the mounting apparatus 100 of FIG. 1 and the mounting apparatus 500 of FIG. 5, except that the base plate 110 has side elements 820 that do not extend upwardly to accommodate attachment of an adapter bridge. As shown in FIG. 9, each side member 112 of the base plate has a bore 114, and each side element 820 has one or more corresponding bores 824. The bores 114 and 824 are situated such that they are axially aligned with each other while the side element 820 is applied to the side member 112. While the bores 114 and 824 are so aligned, a screw 150, bolt, pin or other type of fastener can be inserted through the bores 114 and 824 to secure the respective side elements 820 and side members 112 together, as indicated by broken line 952. A set of threads 154 for receiving and securing each screw 150 may be inserted into or formed within each of the bores 824. Also shown in FIG. 9 is a fastener 160 for securing the base plate 110 to an under barrel 12 of the handgun 10, such as depicted in FIG. 7. The fastener 160 may, for example, thread upwardly through the base plate 110, such as shown in FIG. 3, to engage with the under barrel 12 using an interference fit. As used herein, an interference fit, also known as a press fit or friction fit, is a fastening between two parts which is achieved by friction after the parts are pushed together, rather than by another means of fastening. Other methods of fastening the base plate 110 to the under barrel 12 can be used. A barrel weight 170 can be attached to the base plate 110 and the side elements 820 using one or more of the screws 150 inserted through bores 174 in the barrel weight 170 that secure the base plate 110, the side elements 820 and the barrel weight 170 together. The barrel weight 170, when attached to the mounting apparatus 800, is configured to straddle a muzzle 16 of the handgun 10 while the mounting apparatus 800 is mounted to the handgun 10, similar to the example depicted in FIG. 7. Such an embodiment may be useful, for example, when the only accessory to be mounted to the handgun 10 is the barrel weight 170.

In use, an accessory (not shown) can be mounted to the adapter bridge 130, which is in turn attached to the side elements 120. In various embodiments, the mounting apparatus 100, 500, 800 can be slid onto the under barrel 12 of the handgun 10 from the muzzle end and secured to the under barrel with the fastener 160. The side elements 120 and 820, adapter bridge 130 and/or barrel weight 170 straddle the slide 14 and muzzle 16 and do not interfere with the movement of the slide 14 or block the area around the muzzle 16. In this manner, the handgun 10 can be operated normally while the mounting apparatus 100, 500, 800, accessories and/or barrel weights 170 are attached to the handgun 10.

As will be appreciated in light of this disclosure, the apparatus 100, 500, 800 may include additional, fewer, and/or different elements or components from those here described, and the present disclosure is not intended to be limited to any particular configurations or arrangements of elements such as those variously described herein, but can be used with numerous configurations in numerous applications. Further, while in some embodiments, the apparatus 100, 500, 800 can be configured as shown and described with respect to the various figures, the claimed invention is not so limited. For instance, in some other embodiments, the side elements 120 and/or 820 may be integrally formed with the base plate 110 rather than being separate components. In some other embodiments, the side elements 120, 820 may extend downward, sideways or forward rather than, or in addition to, extending upwardly as shown and described. Such downward, sideways and forward extensions may be used to mount additional accessories below, astride of and/or in front of the under barrel 12 of the handgun 10. In still other embodiments, the orientation and location of the various components described herein, such as the fastener 160, pins 150, and bores 114, may be varied in ways that will be apparent. Other suitable geometries, arrangements and configurations for various elements and components of the apparatus 100, 500, 800 will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. A mounting apparatus comprising:

a base plate having a side member parallel to a longitudinal axis of the base plate, the base plate being configured to be coupled to an under barrel of a firearm;

a side element detachably coupled to the side member of the base plate such that the side element is positioned adjacent to a movable slide mechanism of the firearm while the base plate is coupled to the under barrel; and a first tongue disposed on the side member of the base plate and a second tongue disposed on the side element, wherein the first tongue and the second tongue are each configured to engage a complementary groove formed on one side of the under barrel.

2. The apparatus of claim 1, wherein the base plate has an opposing side member parallel to the longitudinal axis of the base plate, and wherein the apparatus further comprises an opposing side element detachably coupled to the opposing side member of the base plate such that both side elements are positioned adjacent to the movable slide mechanism of the firearm while the base plate is coupled to the under barrel.

3. The apparatus of claim 2, further comprising an adapter bridge coupled to at least one of the side elements such that the adapter bridge is positioned above and avoids interfering with the movable slide mechanism while the adapter bridge is mounted to the firearm.

4. The apparatus of claim 3, wherein the adapter bridge includes one of a Picatinny rail and an optic-specific mount for mounting an accessory thereto.

5. The apparatus of claim 2, further comprising a barrel weight coupled to at least one of the side elements such that the barrel weight straddles a muzzle of the firearm while the base plate is coupled to the under barrel.

6. The apparatus of claim 1, further comprising a screw, wherein the side member and the side element each have bores configured to be axially aligned with each other and to receive the screw for securing the side member and the side element together.

7. The apparatus of claim 1, wherein the first tongue is configured to be axially aligned with the second tongue while the side element is coupled to the side member of the base plate.

8. The apparatus of claim 1, further comprising a fastener configured to secure the base plate to the under barrel.

9. The apparatus of claim 8, wherein the fastener is threaded into an opening formed through the base plate.

10. A kit comprising:

a base plate having a side member parallel to a longitudinal axis of the base plate, the base plate being configured to be coupled to an under barrel of a firearm; and a side element configured to be detachably coupled to the side member of the base plate such that the side element is positioned adjacent to a movable slide mechanism of the firearm while the base plate is coupled to the under barrel;

wherein a first tongue is disposed on the side member of the base plate and a second tongue is disposed on the side element, and wherein the first tongue and the second tongue are each configured to engage a complementary groove formed on one side of the under barrel.

11. The kit of claim 10, wherein the base plate has an opposing side member parallel to the longitudinal axis of the base plate, and wherein the apparatus further comprises an opposing side element configured to be detachably coupled to the opposing side member of the base plate such that both side elements are positioned adjacent to the movable slide mechanism of the firearm while the base plate is coupled to the under barrel.

12. The kit of claim 11, further comprising an adapter bridge configured to be coupled to at least one of the side elements such that the adapter bridge straddles and avoids interfering with the movable slide mechanism while the adapter bridge is mounted to the firearm.

13. The kit of claim 12, wherein the adapter bridge includes one of a Picatinny rail and an optic-specific mount for mounting an accessory thereto.

14. The kit of claim 11, further comprising a barrel weight configured to be coupled to at least one of the side elements such that the barrel weight straddles a muzzle of the firearm while the base plate is coupled to the under barrel.

15. The kit of claim 10, further comprising a screw, wherein the side member and the side element each have bores configured to be axially aligned with each other and to receive the screw for securing the side member and the side element together.

16. The kit of claim 10, wherein the first tongue is configured to be axially aligned with the second tongue while the side element is coupled to the side member of the base plate.

17. The kit of claim 10, further comprising a fastener configured to secure the base plate to the under barrel.

18. The kit of claim 17, wherein the fastener is threaded into an opening formed through the base plate.

19. A mounting apparatus comprising:

a base plate having a side member parallel to a longitudinal axis of the base plate, the base plate being configured to be coupled to an under barrel of a firearm;

a pair of opposing side elements each extending upwardly from respective side members of the base plate such that the side elements are positioned adjacent to a movable slide mechanism of the firearm while the base plate is coupled to the under barrel; and a first tongue disposed on the side member of the base plate and a second tongue disposed on at least one of the opposing side elements, wherein the first tongue and the second tongue are each configured to engage a complementary groove formed on one side of the under barrel.

20. The apparatus of claim 19, further comprising an adapter bridge coupled to at least one of the side elements such that an assembly comprising the base plate, at least one of the side elements and the adapter bridge straddles, and avoids interfering with, the movable slide mechanism while the assembly is mounted to the firearm.

* * * * *